US011373817B2

(12) United States Patent
Guo

(10) Patent No.: US 11,373,817 B2
(45) Date of Patent: Jun. 28, 2022

(54) DIRECT CURRENT ARC EXTINGUISHING CIRCUIT AND APPARATUS

(71) Applicant: Qiaoshi Guo, Guangzhou (CN)

(72) Inventor: Qiaoshi Guo, Guangzhou (CN)

( * ) Notice: Subject to any disclaimer, the term of this patent is extended or adjusted under 35 U.S.C. 154(b) by 121 days.

(21) Appl. No.: 16/633,135

(22) PCT Filed: Jul. 19, 2018

(86) PCT No.: PCT/CN2018/096226
§ 371 (c)(1),
(2) Date: Jan. 22, 2020

(87) PCT Pub. No.: WO2019/019950
PCT Pub. Date: Jan. 31, 2019

(65) Prior Publication Data

US 2021/0159031 A1 May 27, 2021

(30) Foreign Application Priority Data

Jul. 24, 2017 (CN) ..... 201710608043.1
Sep. 15, 2017 (CN) ..... 201710835095.2
(Continued)

(51) Int. Cl.
*H01H 9/54* (2006.01)
*H01H 9/30* (2006.01)
*H01H 33/59* (2006.01)

(52) U.S. Cl.
CPC ..... *H01H 9/548* (2013.01); *H01H 9/30* (2013.01); *H01H 9/542* (2013.01);
(Continued)

(58) Field of Classification Search
CPC ..... H01H 2009/546; H01H 33/04; H01H 33/596; H01H 9/30; H01H 9/54;
(Continued)

(56) References Cited

U.S. PATENT DOCUMENTS 6,621,668 B1 9/2003 Sare
10,176,939 B2 * 1/2019 Park ..... H01H 33/596
(Continued)

FOREIGN PATENT DOCUMENTS

CN 1082247 A 2/1994
CN 2244769 Y 1/1997
(Continued)

OTHER PUBLICATIONS

Australian Examination Report in connection with Australian Application No. 2018308487, dated Feb. 26, 2020 (Year: 2020).*
(Continued)

*Primary Examiner* — Jared Fureman
*Assistant Examiner* — Nicolas Bellido
(74) *Attorney, Agent, or Firm* — Wolf, Greenfield & Sacks, P.C.

(57) ABSTRACT

The present disclosure relates to direct current arc extinguishing circuit and apparatus. The direct current arc extinguishing circuit and apparatus are suitable for quickly extinguishing arc of mechanical contacts such as mechanical switches, where a mechanical switch requiring arc extinguishing is connected with a load in series. It includes a voltage detection switch and a capacitor, wherein the voltage detection switch is connected with the capacitor. During the breaking of the mechanical switch, the capacitor forms a discharge loop by the voltage detection switch and the load, and is used for breaking arc extinguishing of the mechanical switch. The present disclosure is reasonable in design and has the advantages of low cost and high arc extinguishing speed.

30 Claims, 5 Drawing Sheets

(30) Foreign Application Priority Data

| | | |
|---|---|---|
| Sep. 28, 2017 | (CN) | 201710896986.9 |
| Nov. 3, 2017 | (CN) | 201711070356.2 |
| Jan. 11, 2018 | (CN) | 201810026942.5 |
| Apr. 26, 2018 | (CN) | 201810384250.8 |
| Jul. 18, 2018 | (CN) | 201810791947.7 |

(52) U.S. Cl.
CPC ..... *H01H 33/596* (2013.01); *H01H 9/547* (2013.01); *H01H 2009/546* (2013.01)

(58) Field of Classification Search
CPC ..... H01H 9/542; H01H 9/547; H01H 9/548; H01H 2009/543; H01H 2009/544; H01H 2009/545; H01H 33/59; H01H 9/541; H02H 1/0007; H02H 3/087; H02H 3/20; H02H 9/02
See application file for complete search history.

(56) References Cited

U.S. PATENT DOCUMENTS

| | | | | |
|---|---|---|---|---|
| 10,176,947 | B2 * | 1/2019 | Kim | H01H 9/542 |
| 10,229,794 | B2 * | 3/2019 | Hwang | H01H 33/18 |
| 2013/0278078 | A1 | 10/2013 | Ohlsson et al. | |
| 2016/0372278 | A1 * | 12/2016 | Guo | H03K 17/16 |
| 2016/0372285 | A1 * | 12/2016 | Guo | H01H 47/18 |
| 2017/0288388 | A1 * | 10/2017 | Horinouchi | H01H 33/596 |
| 2018/0006446 | A1 * | 1/2018 | Guo | H02H 9/005 |
| 2019/0035571 | A1 * | 1/2019 | Guo | H01H 9/30 |
| 2020/0203093 | A1 * | 6/2020 | Guo | H01H 9/30 |
| 2021/0159031 | A1 * | 5/2021 | Guo | H01H 9/54 |
| 2021/0375561 | A1 * | 12/2021 | Guo | H01H 9/54 |

FOREIGN PATENT DOCUMENTS

| | | | |
|---|---|---|---|
| CN | 104392859 | A | 3/2015 |
| CN | 105 304 413 | A | 2/2016 |
| CN | 106 783 297 | A | 5/2017 |
| CN | 106 847 582 | A | 6/2017 |
| CN | 107863956 | A | 3/2018 |
| JP | S61-153905 | A | 7/1986 |
| JP | 2010-003649 | A | 1/2010 |
| JP | 2010-080200 | A | 4/2010 |
| JP | 2012-059502 | A | 3/2012 |
| JP | 2014-179189 | A | 9/2014 |
| WO | WO 2015/102385 | A1 | 7/2015 |

OTHER PUBLICATIONS

Chinese First Office Action in connection with Chinese Application No. 201711070356.2, dated May 28, 2020.
Chinese First Office Action in connection with Chinese Application No. 201810791947.7, dated May 23, 2019.
Chinese Second Office Action in connection with Chinese Application No. 201810791947.7, dated Jul. 1, 2019.
Chinese Third Office Action in connection with Chinese Application No. 201810791947.7, dated Sep. 17, 2019.
Extended European Search Report in connection with European Application No. 18838450.7, dated May 18, 2020.
International Preliminary Report on Patentability in connection with International Application No. PCT/CN2018/096226, dated Feb. 6, 2020.
Written Opinion in connection with International Application No. PCT/CN2018/096226, dated Oct. 18, 2018.
International Search Report in connection with International Application No. PCT/CN2018/096226 dated Oct. 10, 2018.

* cited by examiner

DIRECT CURRENT ARC EXTINGUISHING CIRCUIT AND APPARATUS

CROSS-REFERENCE TO RELATED APPLICATIONS

This application is a 35 U.S.C. § 371 National Phase filing of International Patent Application No. PCT/CN2018/096226, filed on Jul. 19, 2018, which itself claims the priority to Chinese Patent Application Nos. 201710608043.1, filed on Jul. 24, 2017; 201710835095.2, filed on Sep. 15, 2017; 201710896986.9, filed on Sep. 28, 2017; 201711070356.2, filed on Nov. 3, 2017; 201810026942.5, filed on Jan. 11, 2018; 201810384250.8, filed on Apr. 26, 2018; and 201810791947.7, filed on Jul. 18, 2018 in the State Intellectual Property Office of P.R. China, which are hereby incorporated in their entireties by reference.

TECHNICAL FIELD

The present invention relates generally to arc extinguishing in the field of electrics, and more specifically, to direct current arc extinguishing circuit and apparatus which are suitable for quickly extinguishing arc of mechanical contacts such as mechanical switches, as well as extinguishing arc of other breakpoints, such as fusing of fuse links, breakpoints between plugs and sockets, and breakpoints of wires.

BACKGROUND

Currently, mechanical switches such as contactors (relays) are widely used in various direct current electric control systems such as new energy vehicles, rail transit, ships, etc., to turn on and off the loads. Because direct current has no zero point and its breaking arc is large, it has the shortcomings of high cost of mechanical switches (high voltage contactors) and short electrical life. As the breaking voltage of mechanical switch increases, its electrical life will be greatly reduced. FIG. 1 is a diagram for a brand of high voltage contactor, showing a waveform of the breaking voltage (i.e., arc breaking voltage) corresponding to its electrical life.

BRIEF SUMMARY

One of the objectives of the present disclosure is to solve the problem of short electrical life of mechanical switches in the existing direct current electric control systems and to provide direct current arc extinguishing circuit and apparatus with high arc extinguishing effect, reduced breaking voltage (arc breaking voltage) of the mechanical switches and high arc extinguishing speed.

To achieve the objective of the present disclosure, one aspect of the present disclosure presents a direct current arc extinguishing circuit. The mechanical switch requiring arc extinguishing is connected in series with a load. The circuit comprises a power semiconductor device and a capacitor. The power semiconductor device is connected with the capacitor. During the breaking of the mechanical switch, the power semiconductor device is turned on when the potential difference across the mechanical switch is greater than 5V; a current passes through the power semiconductor device and the load is used for breaking arc extinguishing of the mechanical switch, where the current refers to either a charging current or a discharging current of the capacitor.

In one embodiment, during the breaking of the mechanical switch, the power semiconductor device is turned on in an interval where the potential difference across the mechanical switch is either greater than 5V and less than or equal to 20V, or greater than 20V and less than the working voltage.

In one embodiment, the power semiconductor device is turned on when the mechanical switch is arcing.

In one embodiment, during the breaking of the mechanical switch, the power semiconductor device is turned on when the breakdown voltage of the opening distance between the contacts of the mechanical switch is greater than the working voltage of the mechanical switch.

Another aspect of the present disclosure also presents a direct current arc extinguishing apparatus comprising the foregoing direct current arc extinguishing circuit, wherein the power semiconductor device is a semi-controlled device; a gate of the semi-controlled device is connected with either an anode or a second anode of the semi-controlled device to form a voltage detection switch; the power semiconductor device and the capacitor form a first series circuit; and the first series circuit is connected with the mechanical switch in parallel.

In one embodiment, the direct current arc extinguishing apparatus further comprises a first semiconductor device, wherein the cut-in voltage of the first semiconductor device is greater than 3V and the gate of the semi-controlled device is connected with the anode or the second anode by the first semiconductor device.

In one embodiment, the first semiconductor device is either a Zener diode, or a transient voltage suppressor, or a trigger diode, or a varistor.

In one embodiment, the direct current arc extinguishing apparatus further comprises a second diode, wherein the second diode, the first semiconductor device and the gate of the semi-controlled device are connected in series.

In one embodiment, the detection port of the voltage detection switch is non-insulated and isolated from the output port of the voltage detection switch.

In one embodiment, the voltage detection switch is a time delay semiconductor switch.

In one embodiment, the voltage detection switch is a two-end circuit.

In one embodiment, the direct current arc extinguishing apparatus further comprises a discharge unit for discharging the capacitor, and the discharge unit is connected with the semi-controlled device in parallel.

In one embodiment, the discharge unit comprises either a first diode, or a first current limiting element, or a series connection of a first diode and a first current limiting element.

In one embodiment, it is packaged as a device using insulating material.

In one embodiment, it is packaged as a device with a discharge unit for discharging the capacitor using insulating material.

Yet another aspect of the present disclosure presents a direct current arc extinguishing apparatus comprising the foregoing direct current arc extinguishing circuit, as well as a control unit which is connected with the power semiconductor device.

In one embodiment, the control unit and the power semiconductor device form a voltage detection switch, and a voltage signal of the connection node of the mechanical switch and the load is transmitted to the control unit; the capacitor and the power semiconductor device form a first series circuit, and the first series circuit is connected with the mechanical switch in parallel.

In one embodiment, during the breaking of the mechanical switch, the control unit detects that the contact of the mechanical switch is being broken, and the power semiconductor device is controlled to be turned on by delay, which is greater than 100 microseconds.

In one embodiment, the control unit performs analog-to-digital (A/D) acquisition on the voltage signal.

In one embodiment, the direct current arc extinguishing apparatus further comprises a discharge unit for discharging the capacitor; the discharge unit is connected with the power semiconductor device in parallel; the capacitor is discharged by the mechanical switch and the discharge unit; and the voltage signal is the voltage of the load.

In one embodiment, the voltage signal is either the voltage of the load, or the voltage relative to the other end of the power semiconductor device, or the voltage relative to the power input of the mechanical switch.

In one embodiment, the power semiconductor device is a semi-controlled device.

In one embodiment, either a control signal of the mechanical switch is transmitted to the control unit, or a control signal of the control unit is transmitted to the mechanical switch.

In one embodiment, the control unit stores an adaptive control program, and optimizes arc extinguishing control parameters by utilizing changes of the voltage signal or the voltage signal of the power semiconductor device relative to the other end connected with the load.

In one embodiment, the direct current arc extinguishing apparatus further comprises a discharge unit for discharging the capacitor, wherein the discharge unit at least comprises a discharge switch, and a control signal of the control unit is transmitted to the discharge switch.

In one embodiment, the discharge switch is a first semiconductor switch, which is a semi-controlled device.

In one embodiment, the direct current arc extinguishing apparatus further comprises a first current limiting element, and the discharge switch is connected with the first current limiting element in series.

In one embodiment, the discharge switch is connected with the capacitor in parallel. During the closing operation of the mechanical switch, the control unit controls the discharge switch and the power semiconductor device to be turned on to supply power to the load, and then the mechanical switch is closed; and during the breaking operation of the mechanical switch, the discharge switch is in a cut-off state.

In one embodiment, the direct current arc extinguishing apparatus further comprises a fourth semiconductor switch, wherein the fourth semiconductor switch is a semi-controlled device; the control port of the fourth semiconductor switch is connected with the control unit; the capacitor and the fourth semiconductor switch form a second series circuit; and the input power supply end of the mechanical switch charges the capacitor by the fourth semiconductor switch, the power semiconductor device and the load.

In one embodiment, the direct current arc extinguishing apparatus further comprises a third diode, wherein the capacitor is discharged by the discharge switch and the third diode.

In one embodiment, the discharge switch and the power semiconductor device are semi-controlled switches, a voltage signal of common node of the second series circuit, the discharge switch and the power semiconductor device are connected to the control unit.

In one embodiment, it is used for detecting the working state of the power semiconductor device.

In one embodiment, it is used for detecting the working state of the discharge switch.

In one embodiment, it is used for detecting the working state of the fourth semiconductor switch.

In one embodiment, either a control signal of the mechanical switch is transmitted to the control unit, or a control signal of the control unit is transmitted to the mechanical switch.

In one embodiment, the control unit controls the power semiconductor device to be turned on when the control unit detects arcing in the off state of the mechanical switch.

In one embodiment, the number of mechanical switches is at least two, namely a first mechanical switch and a second mechanical switch; the number of the loads is at least two, namely a first load and a second load; the number of the power semiconductor devices is at least two, namely a first power semiconductor device and a second power semiconductor device.

In one embodiment, the direct current arc extinguishing apparatus further comprises a fourth mechanical switch, wherein the fourth mechanical switch is connected in series with the discharge switch and the first series circuit, and a control signal of the control unit is connected to a control port of the fourth mechanical switch.

In one embodiment, during the breaking of the mechanical switch, the control unit detects that the contact of the mechanical switch is being broken, and controls the power semiconductor device to be turned on with delay, which is greater than 100 microseconds; the control unit either stores or receives parameter related to the current of the load; and the larger the current of the load, the longer the delay.

In one embodiment, the control unit stores an adaptive control program, and optimizes arc extinguishing control parameter by utilizing changes of the voltage signal or the voltage signal of the power semiconductor device relative to the other end connected with the load.

In the direct current arc extinguishing circuit as shown in FIG. 2, a mechanical switch K1 requiring arc extinguishing is connected with a load RL1 in series. The circuit also comprises a power semiconductor device TR1 and a capacitor C1, wherein the power semiconductor device TR1 is connected with the capacitor C1. In the breaking of the mechanical switch K1, the power semiconductor device TR1 is turned on at the potential difference across the mechanical switch K1 greater than 5V. The current passes through the power semiconductor device TR1 and the load RL1, and is used for breaking arc extinguishing by the mechanical switch K1, and the current is the charging current of the capacitor C1 (Note: when the P1 end is connected with the load RL1 end, the current is the discharging current of the capacitor C1).

Working principle: During the breaking of the mechanical switch K1, the power semiconductor device TR1 is turned on when the potential difference across the mechanical switch K1 is greater than 5V; the current output from the power input port of the mechanical switch K1 charges the capacitor C1 by the power semiconductor device TR1 and the load RL1. The current is the charging current of the capacitor C1. The voltage of the load RL1 rises rapidly, and the electric field strength between the contacts of the mechanical switch K1 decreases rapidly, thus achieving the purpose of breaking arc extinguishing of the mechanical switch K1 (i.e., achieving the purpose of no-arc breaking or breaking with extremely short arcing time). Note: the charging power of capacitor C1 shown in FIG. 1 is provided by the power input of mechanical switch K1, which has the advantages of low cost and simple circuit. Other power supply can also be used as the charging power supply of capacitor C1 in practical application.

When the P1 end is changed to be connected with the load RL1 end, the working principle is as follows:

The mechanical switch K1 is closed to control the conduction of the power semiconductor device TR1 and to charge the capacitor C1 (the capacitor can also be fully charged by other power sources in advance). In the breaking of the mechanical switch K1, the power semiconductor device TR1 is turned on when the potential difference across the mechanical switch K1 greater than 5V. The current passes through the power semiconductor device TR1 and the load RL1, and the current is the discharge current of the capacitor C1, the voltage of the load RL1 rises rapidly, and the electric field strength between the contacts of the mechanical switch K1 decreases rapidly, thus achieving the purpose of breaking arc extinguishing of the mechanical switch K1 (i.e., achieving the purpose of no-arc breaking or breaking with extremely short arcing time).

The present disclosure is reasonable in design. When the power semiconductor device TR1 is turned on with a potential difference of the two ends of the mechanical switch K1 being greater than 5V, a certain distance already exists at two ends of the contact of the mechanical switch K1, which makes it easy to quickly extinguish arc, and the arc is not easy to reignite when arc extinguishment or no arc breaking. The present disclosure has the advantages of high arc extinguishing effect, reduced breaking voltage of mechanical switch and high arc extinguishing speed.

DETAILED DESCRIPTION

Figure 3:
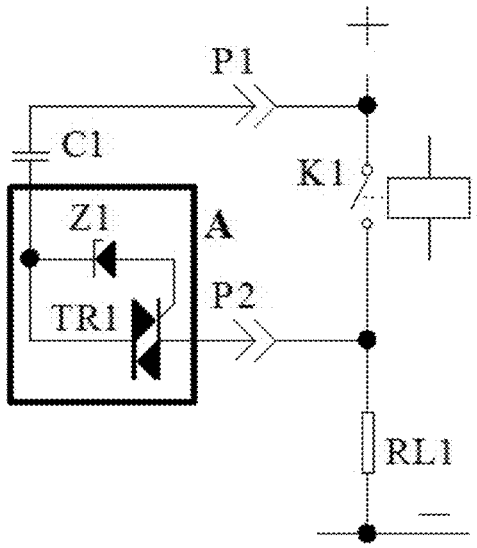
FIG. 3 is a schematic diagram of a circuit of Embodiment 1 of a direct current arc extinguishing apparatus according to the present disclosure.

[Embodiment 1 of a direct current arc extinguishing apparatus of the present disclosure is shown in FIG. 3.

The direct current arc extinguishing circuit of this exemplary embodiment is used for arc extinguishing of a mechanical switch K1 which is connected with a load RL1 in series, and comprises a power semiconductor device TR1 (a semi-controlled device, which is a bidirectional thyristor) and a capacitor C1. During the breaking of the mechanical switch K1, the power semiconductor device TR1 is turned on when the potential difference across the mechanical switch K1 is greater than 5V. The current passes through the power semiconductor device TR1 and the load RL1, and is used for breaking arc extinguishing of the mechanical switch K1, where the current is the charging current of the capacitor C1.

The direct current arc extinguishing apparatus comprises the foregoing direct current arc extinguishing circuit, and further comprises a first semiconductor device Z1 (Zener diode). The gate of the power semiconductor device TR1 is connected to the second anode of the power semiconductor device TR1 by the first semiconductor device Z1 to form a voltage detection switch A. The power semiconductor device TR1 and the capacitor C1 are connected in series to form a first series circuit, and the first series circuit is connected with the mechanical switch K1 in parallel.

Working principle: The mechanical switch K1 is closed, and the capacitor C1 is discharged by the mechanical switch K1 and the power semiconductor device TR1. In the breaking process of the mechanical switch K1, when the potential difference across the mechanical switch K1 is greater than the opening voltage of the voltage detection switch A (greater than 5V), the power semiconductor device TR1 triggers conduction. The input power supply port of the mechanical switch K1 rapidly charges the capacitor C1 by the power semiconductor device TR1 and the load RL1, the voltage across the load RL1 rises, and the electric field strength between contacts of the mechanical switch K1 rapidly decreases, thus achieving the purpose of quickly extinguishing arc of the mechanical switch K1.

In this embodiment, the voltage detection switch A adopts a bidirectional thyristor, which has the advantage of simple circuit.

Figure 4:
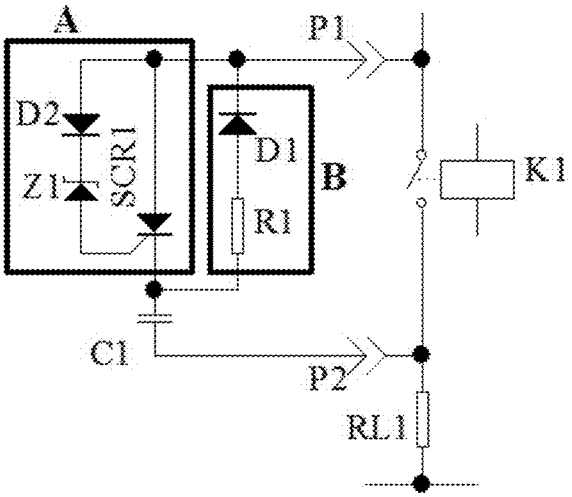
FIG. 4 is a schematic diagram of a circuit of Embodiment 2 of a direct current arc extinguishing apparatus according to the present disclosure.

Embodiment 2 of a direct current arc extinguishing apparatus of the present disclosure is shown in FIG. 4.

The direct current arc extinguishing circuit of this exemplary embodiment is used for arc extinguishing of a mechanical switch K1 which is connected in series with a load RL1, and comprises a power semiconductor device SCR1 (a semi-controlled device, which is a unidirectional thyristor) and a capacitor C1. During the breaking of the mechanical switch K1, the power semiconductor device SCR1 is turned on when the potential difference across the mechanical switch K1 is greater than 5V. The current passes through the power semiconductor device SCR1 and the load RL1, and is used for breaking arc extinguishing of the mechanical switch K1, where the current is the charging current of the capacitor C1.

The direct current arc extinguishing apparatus comprises the foregoing direct current arc extinguishing circuit, and further comprises a first semiconductor device Z1 (Zener diode), a second diode D2 and a discharge unit B. The gate of the power semiconductor device SCR1 is connected to the anode of the power semiconductor device SCR1 by a second diode D2 (for preventing the influence of reverse voltage on the circuit), and the first semiconductor device Z1 forms a voltage detection switch A for detecting the potential difference across the mechanical switch K1. The power semiconductor device SCR1 and the capacitor C1 are connected in series to form a first series circuit, and the first series circuit is connected with the mechanical switch K1 in parallel.

Discharge unit B: It is connected in parallel with power semiconductor device SCR1, and consists of a first diode D1 and a first current limiting element R1 (resistor) connected in series. According to the real-life situation, it can also consist of either a first current limiting element R1 alone or a first diode D1.

Working principle: The mechanical switch K1 is closed, and the capacitor C1 is discharged by the mechanical switch K1 and the discharge unit B. In the breaking of the mechanical switch K1, when the potential difference across the mechanical switch K1 is greater than the opening voltage of the voltage detection switch A, the power semiconductor device SCR1 is triggered to conduct. The capacitor C1 is rapidly charged by power semiconductor device SCR1 and load RL1, the voltage across the load RL1 rises, and the electric field strength between contacts of the mechanical switch K1 rapidly decreases, thus achieving the purpose of quickly extinguishing arc of the mechanical switch K1.

In this embodiment, the voltage detection switch A adopts a unidirectional thyristor, which has the advantages of high current rise rate tolerance and high reliability, and also adopts a discharge unit B, which has the advantage of small current impact when the first current limiting element R1 is connected in series.

In the above embodiments, the voltage detection switch A is a two-end circuit and a semi-controlled switch, which comprises semiconductor devices and has the advantages of simple circuit and low cost.

In the above embodiments 1 and 2, the cut-in voltage of the first semiconductor device Z1 needs to be greater than 3V (to be greater than the peak-to-peak value of the ripple voltage of the system), and the equivalent device such as transient diodes, trigger diodes, or varistors can be used. When the cut-in voltage of thyristors is greater than 5V, the first semiconductor device Z1 is selected according to the needs of the operating conditions.

In the breaking process of the mechanical switch K1, the trigger pole of the power semiconductor device does not need series resistor to limit the current, so that the trigger speed of the power semiconductor device can be improved, the capacitor is charged before the power semiconductor device is turned on, and the capacity utilization rate of the capacitor is improved. In the above embodiments, the detection port of the voltage detection switch A is non-insulated and isolated from the output port of the voltage detection switch A, thus having the advantage of low cost.

Figure 5:
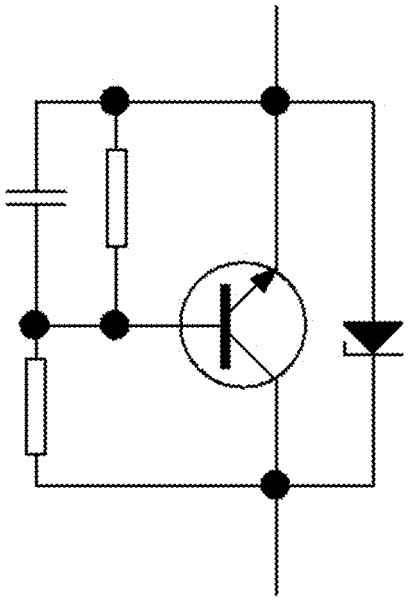
FIG. 5 is a schematic diagram of a time delay circuit of voltage detection switch in a direct current arc extinguishing apparatus according to the present disclosure.

In practical application, a time delay circuit as shown in FIG. 5 or similar circuit can also be used for the first semiconductor device Z1 of the voltage detection switch A. Here, the voltage detection switch A is a delay on switch, which can ensure that the mechanical switch K1 has sufficient opening distance for arc extinguishing to prevent reignition when arc extinguished. The delay in time on the switch is preferably controlled to be greater than 100 microseconds.

Figure 6:
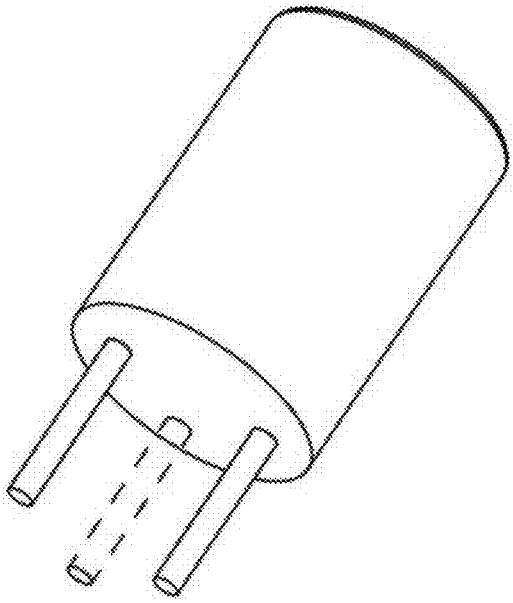
FIG. 6 is a schematic diagram 1 of a package of a direct current arc extinguishing apparatus according to the present disclosure.
Figure 7:
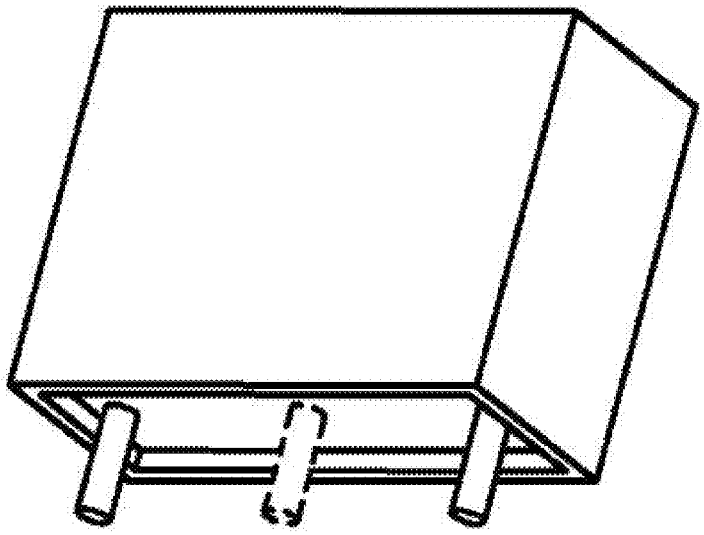
FIG. 7 is a schematic diagram 2 of a package of a direct current arc extinguishing apparatus according to the present disclosure.

In order to facilitate popularization, wide application, standardization, batch production and generalization, the foregoing embodiments can be packaged into a device using insulating materials, and can be in the form of two ends or three ends. The discharge unit can be externally arranged according to the situation (three ends when externally arranged, wherein one end is an end point where a capacitor is connected with a power semiconductor device); it can also be built-in, and can adopt either a circular structure (shown in FIG. 6) or a square structure (shown in FIG. 7).

Figure 8:
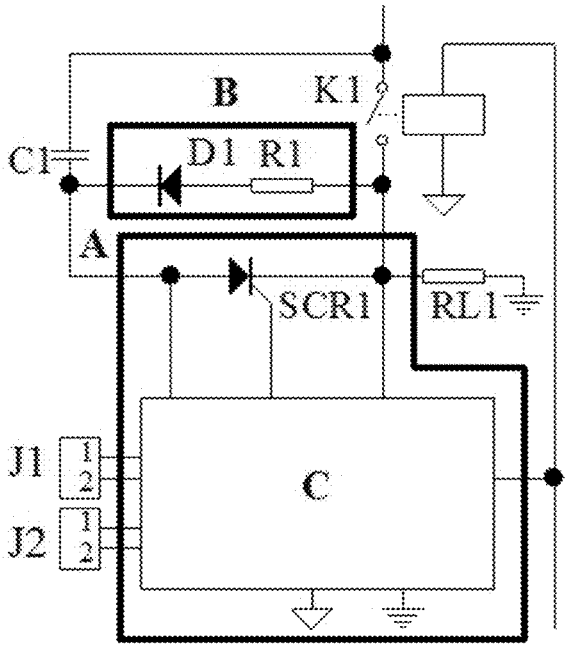
FIG. 8 is a schematic diagram of a circuit of Embodiment 3 of a direct current arc extinguishing apparatus according to the present disclosure.

Embodiment 3 of a direct current arc extinguishing apparatus of the present disclosure is shown in FIG. 8.

The direct current arc extinguishing circuit of this exemplary embodiment is used for arc extinguishing of a mechanical switch K1 which is connected with a load RL1 in series, and comprises a power semiconductor device SCR1 (a semi-controlled device, which is a unidirectional thyristor) and a capacitor C1. During the breaking of the mechanical switch K1, the power semiconductor device SCR1 is turned on when the potential difference across the mechanical switch K1 is greater than 5V. The current passes through the power semiconductor device SCR1 and the load RL1, and is used for breaking arc extinguishing of the mechanical switch K1, where the current is the charging current of the capacitor C1.

The direct current arc extinguishing apparatus comprises the above direct current arc extinguishing circuit, as well as a control unit C and a discharge unit B, wherein the control unit C is connected with the power semiconductor device SCR1 to form a voltage detection switch A. The power semiconductor device SCR1 and the capacitor C1 are connected in series to form a first series circuit, and the first series circuit is connected in parallel with the mechanical switch K1.

Voltage detection switch A: It comprises a control unit C and a power semiconductor device SCR1 (a semi-controlled device and a unidirectional thyristor). The power semiconductor device SCR1 and the capacitor C1 are connected in series to form a first series circuit, which is connected in parallel with the mechanical switch K1, and the voltage signal of the connection node of the mechanical switch K1 and the load RL1 is transmitted to the control unit C. The power semiconductor device SCR1 is connected with the control unit C. In the breaking process of the mechanical switch K1, the power semiconductor device SCR1 is turned on, and the power input port of the mechanical switch K1 charges the capacitor C1 by the power semiconductor device SCR1 and the load RL1. J1 port is the control power supply port; J2 port is a communication port, which is used to receive control instructions and data, and transmit the device and external status information (mechanical switch, load status, etc.). J1 and J2 are optional as required.

Control unit C: It is a built-in programmable device (microcontroller) that can use A/D to collect the voltage of load RL1. The control signal of mechanical switch K1 is transmitted to control unit C (selected as required), or the control mode provided by control unit C (selected as required) with the control signal of mechanical switch K1 can be adopted. It either stores or receives parameter related to the current of the load RL1. During the breaking operation of the mechanical switch K1, it is detected that the contact of the mechanical switch K1 is being broken, and the delay control power semiconductor SCR1 is turned on. The larger the current of the load RL1, the longer the delay time, and the delay time is proportional to the current of the load RL1. During the breaking operation of the mechanical switch K1, the larger the current of the load RL1 is, the larger the voltage difference between the capacitor C1 and the load RL1 is, and the power semiconductor device SCR1 is turned on, which is used for improving the charging current of the capacitor C1 and enhancing the arc extinguishing effect.

Discharge unit B: It is connected in parallel with power semiconductor device SCR1, and capacitor C1 is discharged by mechanical switch K1 and discharge unit B, which comprises either a first diode D1 and a first current limiting element R1 in series, or the first diode D1 alone, or a first current limiting element R1. When the power semiconductor device SCR1 adopts a bidirectional thyristor, the discharge unit B can be selected as required.

Working principle: The mechanical switch K1 is closed, and the capacitor C1 is discharged by the mechanical switch K1 and the discharge unit B (e.g., the capacitor C1 originally stored electric charge). During the breaking of the mechanical switch K1, the control unit C detects that the contact of the mechanical switch K1 is being broken, and delays the conduction of the power semiconductor device SCR1 (the delay is more than 100 microseconds, or conforms to the voltage value set by the control unit C at the same time, and the delayed time value is related to the breaking speed of the mechanical switch K1). Alternatively, when it is detected that the voltage signal of the connection node of the mechanical switch K1 and the load RL1 reaches a preset voltage value (or simultaneously accords with the time value set by the control unit C, which is related to the breaking speed of the mechanical switch K1), the power semiconductor device SCR1 is controlled to be conductive. The capacitor C1 is rapidly charged by power semiconductor device SCR1 and load RL1, the voltage across the load RL1 rapidly rises, and the electric field strength between the contacts of the mechanical switch K1 rapidly decreases, thus achieving the purpose of rapidly extinguishing arc of the mechanical switch K1.

In this embodiment, the voltage signal of the connection node of the mechanical switch K1 and the load RL1 may be either a voltage signal of the load RL1, or a potential difference between the capacitor C1 and the load RL1 (i.e., the voltage of the other end of the power semiconductor device SCR1). When the input power supply end of the mechanical switch K1 is powered on, there will be no impact current from the capacitor C1. The voltage detection switch A adopts a unidirectional thyristor, which has the advantages of high current rise rate tolerance and high reliability. Meanwhile, the discharge unit B is adopted, which has the advantage of small current impact of closing current of the mechanical switch K1 (when the first current limiting element is connected in series). The control unit C stores an adaptive control program. In the breaking process of the mechanical switch K1, the change of the voltage signal of the connection node of the mechanical switch K1 and the load RL1 or the voltage signal of the other end of the connection node of the power semiconductor device SCR1 and the load RL1 (i.e., the connection node of the capacitor C1 and the power semiconductor device SCR1) is utilized to optimize the arc extinguishing control parameter (i.e., adjust the time difference between controlling the conduction of the power semiconductor device and the disconnection of the contact of the mechanical switch) to achieve the best arc extinguishing effect. The control unit C comprises a programmable device, which has a built-in intelligent unit used for program controlling, which can complete timing, A/D acquisition, voltage comparison, logic processing and so on, is good for simplifying the circuit. It can adjust the control mode according to different conditions (voltage changes) of the load, improve the arc extinguishing effect, and effectively prolong the electrical life of the mechanical switch. The electrical life of the mechanical switch is calculated according to the arcing condition and the operation times, the contact state (on state, off state, arcing state) of the mechanical switch K1 can be detected in real time without auxiliary contacts, and relevant information is transmitted.

Figure 9:
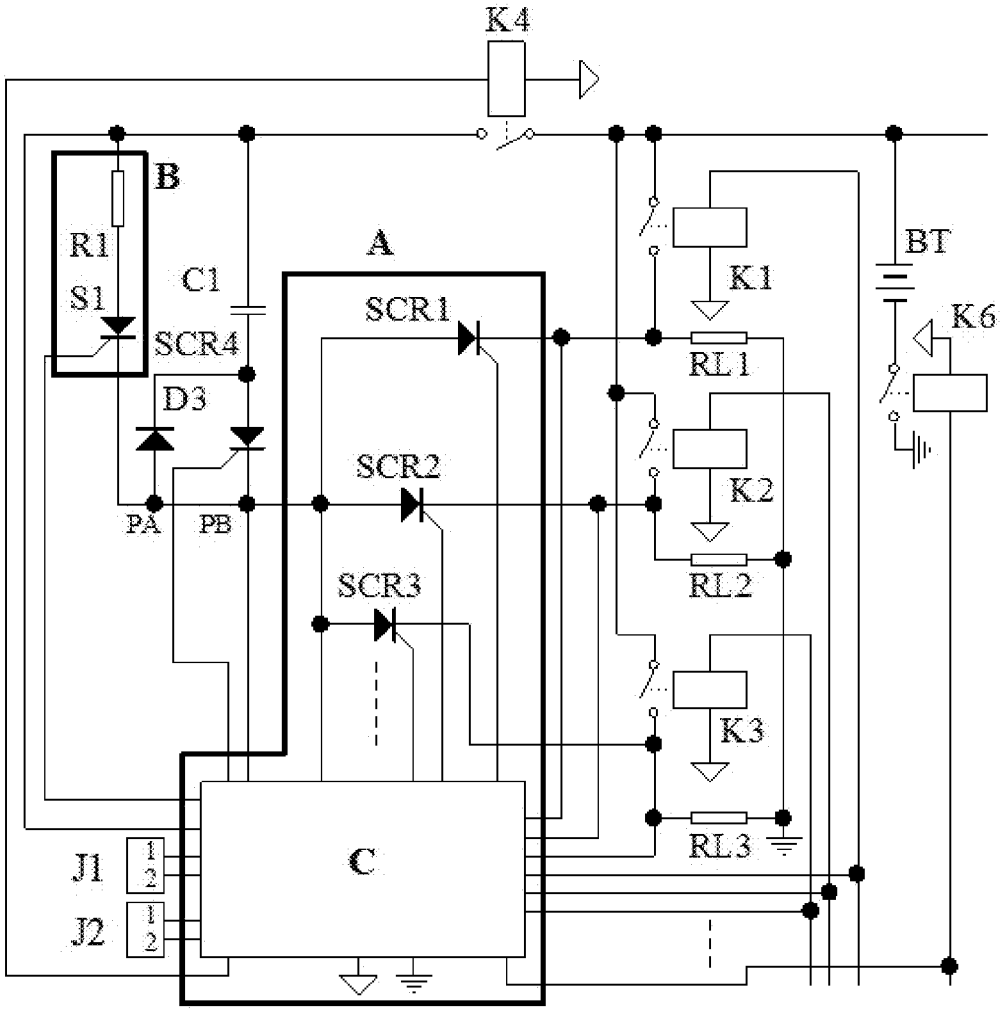
FIG. 9 is a schematic diagram of a circuit of Embodiment 4 of a direct current arc extinguishing apparatus according to the present disclosure.

Embodiment 4 of a direct current arc extinguishing apparatus of the present disclosure is shown in FIG. 9.

The direct current arc extinguishing circuit of this exemplary embodiment is used for arc extinguishing of the mechanical switch (K1, K2, K3) which is connected in series with load (RL1, RL2, RL3), and comprises power semiconductor device (semi-controlled device; SCR1, SCR2 and SCR3 are unidirectional thyristors) and capacitor C1. During the breaking of the mechanical switch K1, the potential difference across the mechanical switch (K1, K2, K3) of the power semiconductor device (SCR1, SCR2, SCR3) is more than 5V to conduct. Current passes through power semiconductor device (SCR1, SCR2, SCR3) and load (RL1, RL2, RL3), and is used for breaking arc extinguishing by mechanical switch (K1, K2, K3). The current is the charging current of capacitor C1.

A direct current arc extinguishing apparatus (namely, a direct current arc management system) that is suitable for multiplex mechanical switches electric control systems, comprises the above direct current arc extinguishing circuits. The power semiconductor device (SCR1, SCR2, SCR3) and capacitor C1 are connected in series to form a first series circuit, and the first series circuit is connected in parallel with mechanical switch (K1, K2, K3). It further comprises a control unit C, a discharge unit B, a third diode D3, a fourth semiconductor switch SCR4 (the semi-controlled device, unidirectional thyristor, PA and PB can be disconnected as required, but is not recommended; when PA and PB are disconnected, a control unit C needs to collect the voltages of PA and PB) and a fourth mechanical switch K4. The control signal of the fourth mechanical switch K4 is provided by the control unit C, and the control unit C is connected with the power semiconductor device (SCR1, SCR2, SCR3) to form the voltage detection switch A. The third diode D3 is connected in parallel with the fourth semiconductor switch SCR4, and the control port of the fourth semiconductor switch SCR4 is connected with the control unit C. A voltage signal of a common end PB of a second series circuit (which is formed by the capacitor C1, the fourth semiconductor switch SCR4), a first semiconductor switch S1 (semi-controlled device, unidirectional thyristor, charging switch) of the discharge unit B, and a power semiconductor device (SCR1, SCR2, SCR3, semi-controlled device, unidirectional thyristor) that is connected to the control unit C. The input power supply port of the mechanical switch (K1, K2, K3) is connected with a battery BT, and the negative electrode of the battery BT is connected with the working ground by a sixth mechanical switch K6 (main negative contactor). The J1 port is the control power supply port, and J2 port is a communication port, which is used to receive control instructions and data, and to transmit the device and external status information (mechanical switch, load status, etc.). J1 and J2 are selected as required.

Voltage detection switch A: It comprises a control unit C and power semiconductor device (SCR1, SCR2, SCR3). The power semiconductor device (SCR1, SCR2, SCR3), the fourth semiconductor switch SCR4 (selected as required) and the capacitor C1 form a first series circuit, which is connected in parallel with the mechanical switch (K1, K2, K3). The voltage signal of connection node of mechanical switch (K1, K2, K3) and load (RL1, RL2, RL3) is transmitted to the control unit C; and the power semiconductor device (SCR1, SCR2, SCR3) is connected to the control unit C.

Control unit C: It is a built-in programmable device (microcontroller) for A/D acquisition of voltage signal of load (RL1, RL2, RL3) and common end PB, and a voltage signal of the input power supply port of the mechanical switch K1 is connected to the control unit C (A/D acquisition). During the breaking operation of the mechanical switch (K1, K2, K3), it is detected that the contact of the mechanical switch (K1, K2, K3) is being broken, and delay control the conduction of power semiconductor device (SCR1, SCR2, SCR3). The electrical characteristics of the mechanical switch (K1, K2, K3) and the load (RL1, RL2, RL3) connected to the control unit C are not necessarily coincident. Thus, in order to achieve the best arc extinguishing effect, the control unit C needs to either store or receive the parameter related to the current of the load (RL1, RL2, RL3). During the breaking operation of the mechanical switch (K1, K2, K3), the larger the current of the load (RL1, RL2, RL3), the longer the delay, and the delay is proportional to the current of the load (RL1, RL2, RL3). The time parameter of the delay control can be completed by a microcontroller which is built in the control unit C. The control signal of the mechanical switch (K1, K2, K3, K5, K6) is transmitted to the control unit C (improves arc extinguishing accuracy and real-time performance, and can be selected according to needs). The control mode, in which the control signal of the mechanical switch (K1, K2, K3, K5, K6) is provided by the control unit C, can also be adopted (which is more beneficial to optimizing and controlling the action logic and arc extinguishing control logic of each mechanical switch, and can be selected according to needs).

Discharge unit B: It comprises a first current limiting element R1 (resistor, which can be omitted when the third diode D3 is connected in series with the current limiting element and the load is a non-capacitive load), and a first semiconductor switch S1 (semi-controlled device, unidirectional thyristor). The first semiconductor switch S1 is a discharge switch, and the control signal of the control unit C controls the first semiconductor switch S1 to be turned on. The capacitor C1 is discharged by the first current limiting element R1, the first semiconductor switch S1, and the third diode D3 (optional if necessary when the fourth semiconductor switch SCR4 adopts a bidirectional thyristor).

Working principle: The mechanical switch K6 is closed, when the power input of the mechanical switch (K1, K2, K3) are powered on (the battery BT is turned on). The control unit C first controls the fourth mechanical switch K4 to be closed, and then the control unit C provides a pulse signal to trigger the first semiconductor switch S1 to conduct to discharge the capacitor C1. When the discharge current is less than the minimum on-hold current of the first semiconductor switch S1, the first semiconductor switch S1 turns off on its own. When the closing operation of the mechanical switch (K1, K2, K3), the control unit C provides a pulse signal to trigger the first semiconductor switch S1 and the power semiconductor device (SCR1, SCR2, SCR3) to conduct and charge (supply power) to the load (RL1, RL2, RL3) (such as the motor controller, direct current converter, etc.), which can effectively overcome the current impact of capacitive load on the mechanical switch (K1, K2, K3) and closing arc. The control unit C can decide whether the first semiconductor switch S1 and the power semiconductor device (SCR1, SCR2, SCR3) are turned off or not by detecting the voltage of the common end PB, and if turned off, the mechanical switch (K1, K2, K3) is also closed.

During the breaking of the mechanical switch (K1, K2, K3), the first semiconductor switch S1 is in an off state. The control unit C detects that the contacts of the mechanical switch (K1, K2, K3) are disconnected, and then controls the fourth semiconductor switch SCR4 and the power semiconductor device (SCR1, SCR2, SCR3) to be turned on in delay (the delay is more than 100 microseconds, which can be completed by the built-in microcontroller, or conforms to the voltage value set by the control unit C at the same time, and the time delay value is related to the breaking speed of the corresponding mechanical switch). Alternatively, when it detected that the voltage signal at the connection node of the mechanical switch (K1, K2, K3) and the load (RL1, RL2, RL3) reach a set voltage value (or conforms to the time value set by the control unit C at the same time, which is related to the breaking speed of the corresponding mechanical switch), the fourth semiconductor switch SCR4 and the power semiconductor device (SCR1, SCR2, SCR3) are controlled to be conductive. The control unit C can decide whether the fourth semiconductor switch SCR4 and the power semiconductor device (SCR1, SCR2, SCR3) is in an on state by detecting the voltage of the common end PB. The input power supply port of the mechanical switch (K1, K2, K3) rapidly charges the capacitor C1 by the fourth semiconductor switch SCR4, the power semiconductor device (SCR1, SCR2, SCR3) and the load (RL1, RL2, RL3); the voltage across the load (RL1, RL2, RL3) rises, and the electric field strength between contacts of the mechanical switch (K1, K2, K3) rapidly decreases, hence achieving the purpose of rapidly extinguishing arc of the mechanical switch (K1, K2, K3). The control unit C detects whether the fourth semiconductor switch SCR4 and the power semiconductor device (SCR1, SCR2, SCR3) is in the off state by detecting the voltage of the common end PB, so as to judge whether the capacitor C1 has completed charging and get prepared for the next discharging of the capacitor C1.

The control unit C performs A/D acquisition (or high and low level acquisition) on the voltage signal of the common end PB, and has the following advantages:

The fourth semiconductor switch SCR4, the first semiconductor switch S1, and the power semiconductor device (SCR1, SCR2, SCR3) can be quickly and accurately detected in an on state, an off state (whether charging or discharging is completed), and a breakdown state by using a single endpoint without high-resolution A/D acquisition, thereby ensuring the response speed and safety of the system.

The load (RL1, RL2, RL3) is of wide range, such as motor controllers, DC/DC converters, motors, resistors, etc.

A voltage signal of the connection node of the mechanical switch (K1, K2, K3) and the load (RL1, RL2, RL3) is the voltage of the load (RL1, RL2, RL3) (when the control unit C is used for A/D acquisition of the voltage signal, it has the advantages of not affecting the insulation withstand voltage of the two ends of the mechanical switch K1, and no leakage current when the mechanical switch K1 is normally open). The voltage signal may also be a voltage with respect to either the other end of the power semiconductor device (SCR1, SCR2, SCR3) or the power input port of the mechanical switch (K1, K2, K3).

In the breaking process of the mechanical switch, when the change speed of the voltage signal is less than the change speed set by the control unit C, the control unit C does not provide the relevant power semiconductor device conduction control signal to prevent: the capacitor C1 from charging too slowly, the power semiconductor device (SCR1, SCR2, SCR3) from turning off too slowly and thus affecting the arc extinguishing response speed of other mechanical switches. The control unit C stores the parameter related to the residual voltage change of the load, which is beneficial to improving the accuracy of the breaking detection of the mechanical switch. The control unit C stores an adaptive control program. During the breaking of the mechanical switch (K1, K2, K3), the change of the voltage signal of the connection node of the mechanical switch (K1, K2, K3, K5)

and the load (RL1, RL2, RL3) or the voltage signal of the other end (PB) of the connection node of the power semiconductor device (SCR1, SCR2, SCR3) and the load (RL1, RL2, RL3) is utilized to optimize the arc extinguishing control parameter(s) (i.e., to adjust the time difference between the conduction of the power semiconductor devices and the disconnection of the contacts of the mechanical switches) so as to achieve the optimal arc extinguishing effect.

The mechanical switch K1, the mechanical switch K2 and the mechanical switch K3 are respectively defined as a first mechanical switch, a second mechanical switch and a third mechanical switch.

The load RL1, the load RL2 and the load RL3 are respectively defined as a first load, a second load, and a third load.

The power semiconductor device SCR1, the power semiconductor device SCR2, and the power semiconductor device SCR3 are respectively defined as a first power semiconductor device, a second power semiconductor device, and a third power semiconductor device.

When used in the occasions of arc extinguishing of multiplex mechanical switches such as new energy vehicles and arc extinguishing fails, the sixth mechanical switch K6 is controlled to break. The control unit C controls the fourth mechanical switch K4 to be turned off when detecting abnormality (such as breakdown or misleading of the first semiconductor switch, breakdown or misleading of the power semiconductor device). Except for the sixth mechanical switch K6 and the fourth mechanical switch K4, the other mechanical switch (K1, K2, K3) of the direct current arc extinguishing apparatus of this disclosure can adopt common (non-sealed high-voltage) contactors, which can greatly reduce the cost and improve the safety (no risk of air leakage). Especially when it is applied to the working conditions where automobiles and similar appliances are in motion and unexpected mechanical impacts (such as collision, rollover, etc.) may occur. Mechanical switch (K1, K2, K3) may accidentally close and break in a normally open state, or the opening distance may become smaller, or impact voltages may occur at two ends of mechanical switch (K1, K2, K3), and arcing may occur at this time. When the control unit C detects arcing under the breaking state of the mechanical switch (K1, K2, K3), the control unit C controls conduction of power semiconductor device (SCR1, SCR2, SCR3), and the capacitor C1 forms a discharge loop by the power semiconductor device (SCR1, SCR2, SCR3) and the load (RL1, RL2, RL3) to extinguish arc. When the control unit C detects the failure of arc extinguishing, it outputs a signal to control the mechanical switch K6 to break.

In this embodiment, the control unit C comprises a programmable device, which has a built-in intelligent unit used for program controlling. It can adjust the control mode according to different conditions of the load (RL1, RL2, RL3) and mechanical switch (K1, K2, K3), improve the arc extinguishing effect, and effectively prolong the electrical life of the mechanical switch. Timing (delay control power semiconductor device), A/D acquisition, voltage comparison, logic processing, etc. can also be completed, which is beneficial to simplifying the circuit. A capacitor, a control unit and a discharge switch are jointly used for arc extinguishing control, pre-charging (or closing arc extinguishing) and detection (on state, off state and arcing state) of a multiplex mechanical switches (a series circuit formed by each mechanical switch and each load, and each series circuit is in parallel relation). The electrical life of the mechanical switch is calculated according to the arcing conditions and the operation times, and relevant information (fault codes, etc.) is transmitted. As a direct current arc extinguishing apparatus (direct current arc management system) with arc management and arc extinguishing functions, it is conducive to improving the overall safety of the electric control systems and has the characteristics of higher cost performance, and can be widely applied to new energy vehicles, rail transit, ships, aviation, automatic control and other fields.

According to real-life working condition, the capacitor C1 and the fourth semiconductor switch can also be multiple, which can improve the response speed. They can adopt a multi-pulse arc extinguishing mode (two or more capacitors, arc of the mechanical switch is extinguished by two or more pulses), and the discharge unit B can also adopt a switching power supply.

In the embodiments 3 and 4, it is suggested that the control unit C should use a transformer to trigger a power semiconductor device. The control unit C stores an adaptive control program. The control unit C adjusts the time difference between the conduction of the power semiconductor device and the disconnection of the contact of the mechanical switch, by using the voltage change rate of the voltage signal of the connection node of the mechanical switch and the load in the breaking process of the mechanical switch. A small rate of change means a large breaking current, and the time difference needs to be increased, so that the contacts of the mechanical switch have a relatively large opening distance, and the arc breaking capability of the mechanical switch is strong. Combined with capacitor is charged to extinguish the arc, the purpose of stable and reliable arc extinguishing can be achieved.

In the above embodiments, the electrical parameter of the voltage detection switch can be selected with reference to the following requirements:

1. When the working voltage of the mechanical switch is less than or equal to 200V, or when the capacitance is large, the voltage detection switch can be designed to conduct in an interval where the potential difference across the mechanical switch is greater than 5V and less than or equal to 20V (when the capacitance is large enough, the voltage value can be appropriately lowered).

2. When the working voltage of the mechanical switch is greater than 200V, or the capacitance is small, or the internal resistance of the charge circuit is large, the power semiconductor device can be designed to conduct in an interval where the voltage across the mechanical switch is greater than 20V and less than the working voltage of the mechanical switch in the breaking process of the mechanical switch; and preferably less than ½ of the working voltage of the mechanical switch. This is because during the breaking of the mechanical switch, the voltage across the mechanical switch rises at a high rate between 0 and 20V. It is used to obtain larger charge current and larger opening distance of mechanical switches and improve the reliability of arc extinguishing.

3. The power semiconductor device is turned on when the mechanical switch is arcing. Because the voltage change rate at two ends of the mechanical switch is large and the distance between the contacts of the mechanical switch is extremely small during the breaking of the mechanical switch and before arcing of the mechanical switch, it requires a large capacitance of capacitor to stabilize arc extinguishing, i.e., no-arc breaking. The arc is extinguished completely within 100 microseconds when the power semiconductor device is turned on, and if the time is too long, the capacitor needs an extreme large capacitance, and the arc extinguishing stability is poor.

4. During the breaking of the mechanical switch, the power semiconductor device is turned on, when the breakdown voltage of the opening distance between the contacts of the mechanical switch is greater than the working voltage of the mechanical switch; thus, the purpose can be achieved by the delay conduction of the power semiconductor device. The delay control of the power semiconductor device can be completed by the delay circuit (such as the microcontroller of the control unit or the delay circuit of the resistance-capacitance) when the contacts of the mechanical switch are detected to be disconnected; or it conducts the power semiconductor device when the voltage detection switch detects a higher voltage across the mechanical switch (i.e., the voltage detection switch with high opening voltage). It has the advantages of effectively preventing the arc from reigniting when arc extinguishing and requiring minimal capacitance. The parameter can be adjusted according to the breaking speed of the mechanical switch, the capacitance of capacitor, the working voltage of the mechanical switch and the characteristics of the load.

In the above embodiments, the capacitance requirement can be reduced by decreasing the inductance of the charge circuit as much as possible and increasing the rising rate of the charge current of the capacitor within the range of the current rising rate of the power semiconductor device. The power semiconductor device can adopt unidirectional thyristors greater than 180 A per microsecond (multiple thyristors can be used in parallel), by using the internal resistance of the discharge circuit. The operation of the power semiconductor device is in a safe range, and the arc extinguishing speed and reliability are improved.

In the foregoing embodiments, the mechanical switch is a contactor (relay). In the present disclosure, any mechanical breakpoint as an arc extinguishing target can also be defined as a mechanical switch, such as a fuse link, a connector, etc.

In summary, the present disclosure has the following advantages:

1. Due to the large potential difference is formed at two ends of the mechanical switch, the power semiconductor device is turned on, and it is beneficial to overcome the influence of the internal resistance of the capacitor charge circuit, improving the instantaneous charge current of the capacitor, and achieving low capacitance of capacitor requirements. Due to the small capacitance of capacitor, it has the advantages of low cost, small volume, high reliability, and low power required by the first current limiting element and fast response speed (i.e., fast charging and discharging speed, which is very important for improving the response speed of arc extinguishing of multiplex mechanical switches. When the capacitance is designed to be 30 microfarads, the first current limiting element is designed to be 33 ohms for arc extinguishing of mechanical switches loaded with tens of ampere to hundreds of ampere, which can complete the entire arc extinguishing process of capacitor charging and discharging in ten milliseconds. According to the technical scheme shown in FIG. 9, the arc extinguishing of tens or even hundreds of mechanical switches can be completed in one second). For a load of 800V and 500 A, only a few tens of microfarads of capacitance can satisfy the requirement of extinguishing the arc within a few microseconds to tens of microseconds (not exceeding 100 microseconds).

2. Compared with full-controlled type devices, the adopted semi-controlled type devices (switches) have the advantages of large overload capacity, short conduction time, low cost, and no breaking overvoltage when the current crosses zero and cut off, which can economically solve the arc extinguishing problem of loads above 100 ampere (unidirectional thyristors with rated working current of 25 ampere can be adopted to extinguish arc for current above hundreds ampere).

3. The arc extinguishing mode, which is connected in parallel with the mechanical switch, is convenient to use as a whole with the mechanical switch, and the arc extinguishing mode of capacitor charging can effectively overcome the phenomenon of removing load overvoltage.

4. When the working voltage fluctuates, the voltage detection switch is not conductive and the voltage detection switch has no temperature rise, thus the electrical life of capacitor is long.

5. It has wide application range, and can extinguish arc for manually controlled switches, stroke switches and other mechanical switches without control coils.

Figure 1:
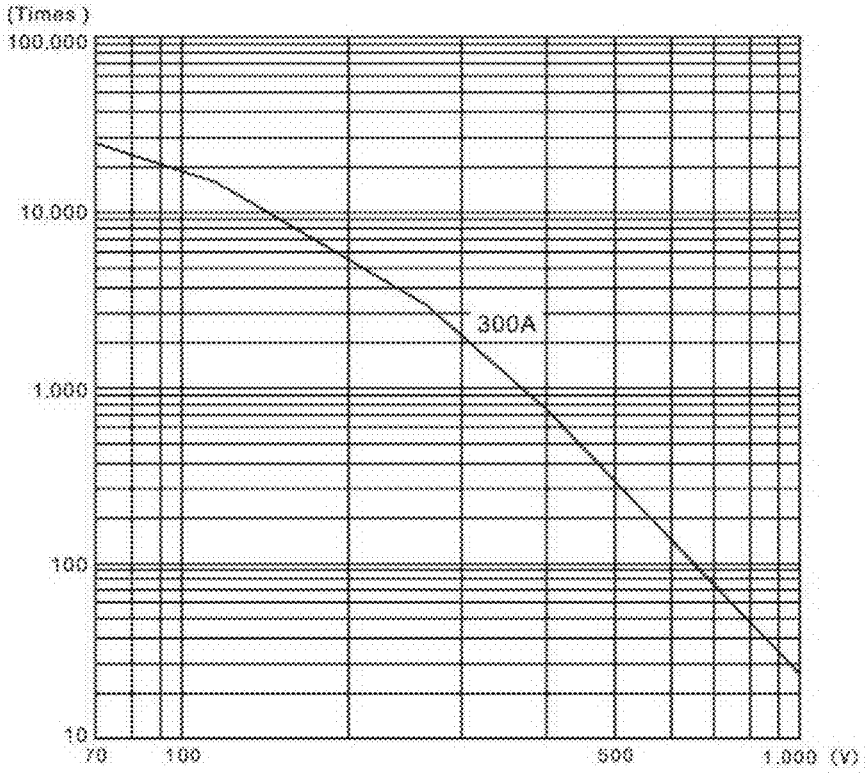
FIG. 1 is a diagram for a brand of high voltage contactor showing a waveform of breaking voltage versus electrical life.
Figure 2:
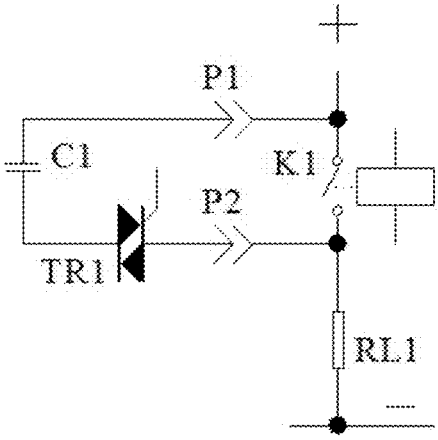
FIG. 2 is a schematic diagram of a circuit of a direct current arc extinguishing circuit according to the present disclosure.

6. The breaking voltage (arc breaking voltage) of the mechanical switch is reduced, and the electrical life of the mechanical switch is greatly prolonged (as shown in FIG. 1, when the working voltage across the mechanical switch is 600V and the load current is 300 A, the electrical life is about 150 times). When the mechanical switch is matched with the direct current arc extinguisher of the disclosure, in the working process of breaking the mechanical switch, the power semiconductor device is turned on when the voltage of the two ends of the mechanical switch is 90V (i.e., the opening value of the voltage detection switch is designed to be 90V), which is equivalent to breaking the direct current of 90V/300 A by the mechanical switch, and the electrical life of the mechanical switch can reach more than 20,000 times.

What is claimed is:

1. A direct current arc extinguishing circuit, configured to extinguish an arc of a mechanical switch which is connected in series with a load, the circuit comprising:

a power semiconductor device and a capacitor, wherein:

the power semiconductor device is connected with the capacitor, and the circuit is configured such that:

during the breaking of the mechanical switch, the power semiconductor device is turned on when a potential difference across the mechanical switch is greater than 5V and less than or equal to 20V; or greater than 20V and less than a working voltage of the mechanical switch; and when the power semiconductor device is turned on, a current passes through the power semiconductor device and the load such that a breaking arc of the mechanical switch is extinguished, with the current being either a charging current or a discharging current of the capacitor.

2. The direct current arc extinguishing circuit according to claim 1 in combination with a control unit connected with the power semiconductor device, wherein the direct current arc extinguishing circuit and the control unit comprise a direct current arc extinguishing apparatus.

3. The direct current arc extinguishing apparatus according to claim 2, wherein the control unit and the power semiconductor device form a voltage detection switch, a voltage signal of a connection node of the mechanical switch and the load is transmitted to the control unit, the capacitor and the power semiconductor device form a first series circuit, and the first series circuit is connected in parallel with the mechanical switch.

4. The direct current arc extinguishing apparatus according to claim 3, wherein the control unit is configured such that during the breaking of the mechanical switch, the control unit detects that a contact of the mechanical switch is being broken, and the power semiconductor device is controlled to be turned on after a delay greater than 100 microseconds.

5. The direct current arc extinguishing apparatus according to claim 3, wherein the control unit performs A/D acquisition on the voltage signal.

6. The direct current arc extinguishing apparatus according to claim 5, further comprising a discharge unit for discharging the capacitor, wherein the discharge unit is connected in parallel with the power semiconductor device, the capacitor is discharged by the mechanical switch and the discharge unit, and the voltage signal is the voltage of the load.

7. The direct current arc extinguishing apparatus according to claim 3, wherein the voltage signal is either a voltage of the load, or a voltage relative to another end of the power semiconductor device, or a voltage relative to the power input of the mechanical switch.

8. The direct current arc extinguishing apparatus according to claim 3, wherein the control unit is configured either to receive a control signal of the mechanical switch or to transmit a control signal to the mechanical switch.

9. The direct current arc extinguishing apparatus according to claim 3, wherein the control unit stores an adaptive control program that is configured to set an arc extinguishing control parameter by utilizing change of the voltage signal or the voltage signal of the power semiconductor device relative to another end connected with the load.

10. The direct current arc extinguishing apparatus according to claim 3, further comprising a discharge unit for discharging the capacitor, wherein the discharge unit at least comprises a discharge switch configured to receive a control signal from the control unit.

11. The direct current arc extinguishing apparatus according to claim 10, wherein:

the discharge switch is connected with the capacitor in parallel, the control unit is configured to control the discharge switch and the power semiconductor device to be turned on to supply power to the load during the closing operation of the mechanical switch before the mechanical switch is closed; and during the breaking operation of the mechanical switch, the discharge switch is in a cut-off state.

12. The direct current arc extinguishing apparatus according to claim 10, further comprising a fourth semiconductor switch, wherein a control port of the fourth semiconductor switch is connected with the control unit; the capacitor and the fourth semiconductor switch form a second series circuit; and the capacitor is coupled to an input power supply end of the mechanical switch for charging through the fourth semiconductor switch, the power semiconductor device and the load.

13. The direct current arc extinguishing apparatus according to claim 12, further comprising a diode, wherein the diode is configured such that the capacitor discharges though the discharge switch and the diode.

14. The direct current arc extinguishing apparatus according to claim 12, wherein a voltage signal of common end of the second series circuit, the discharge switch and the power semiconductor device are connected to the control unit.

15. The direct current arc extinguishing apparatus according to claim 10, wherein the control unit is configured either to receive a control signal of the mechanical switch or to transmit a control signal to the mechanical switch.

16. The direct current arc extinguishing apparatus according to claim 10, wherein:

the power semiconductor device is a first the power semiconductor device;

the apparatus comprises:

at least two mechanical switches, including a first mechanical switch and a second mechanical switch;

at least two loads, including a first load and a second load;

at least two power semiconductor devices, including the first power semiconductor device and a second power semiconductor device.

17. The direct current arc extinguishing apparatus according to claim 16, wherein:

the control unit is configured to:

detect during the breaking of the mechanical switch that a contact of the mechanical switch is being broken, and control the power semiconductor device to be turned on with delay, which is greater than 100 microseconds; and store or receive a parameter related to a current of the load; and the delay time is longer when the current of the load is larger during the breaking of the mechanical switch.

18. The direct current arc extinguishing circuit according to claim 1, wherein:

the power semiconductor device is a first the power semiconductor device;

the circuit is in combination with:

at least two mechanical switches, including a first mechanical switch and a second mechanical switch;

at least two loads, including a first load and a second load;

at least two power semiconductor devices, including the first power semiconductor device and a second power semiconductor device.

19. The direct current arc extinguishing circuit according to claim 1, wherein:

the power semiconductor device comprises a voltage detection switch, the power semiconductor device and the capacitor form a first series circuit, and the first series circuit is connected with the mechanical switch in parallel, and the voltage detection switch is configured to be energized from a voltage signal across the mechanical switch.

20. The direct current arc extinguishing circuit according to claim 19, wherein:

the power semiconductor device is a semi-controlled device, and a gate of the semi-controlled device is connected with either an anode or a second anode of the semi-controlled device to form the voltage detection switch.

21. The direct current arc extinguishing circuit according to claim 20, further comprising a first semiconductor device, wherein the cut-in voltage of the first semiconductor device is greater than 3V and the gate of the semi-controlled device is connected with either the anode or the second anode by the first semiconductor device.

22. The direct current arc extinguishing circuit according to claim 21, wherein the first semiconductor device is either a Zener diode, or a transient voltage suppressor, or a trigger diode, or a varistor.

23. The direct current arc extinguishing circuit according to claim 22, further comprising a second diode, wherein the second diode, the first semiconductor device and the gate of the semi-controlled device are connected in series.

24. The direct current arc extinguishing circuit according to claim 19, wherein the detection end of the voltage detection switch is non-insulated and isolated from the output port of the voltage detection switch.

25. The direct current arc extinguishing circuit according to claim 19, wherein the voltage detection switch is a time delay semiconductor switch.

26. The direct current arc extinguishing circuit according to claim 19, wherein the voltage detection switch is a two-end circuit.

27. The direct current arc extinguishing circuit according to claim 19, further comprising a discharge unit for discharging the capacitor, with the discharge unit being connected with the semi-controlled device in parallel.

28. The direct current arc extinguishing circuit according to claim 27, wherein the discharge unit comprises either a first diode, or a first current limiting element, or a series connection of the first diode and the first current limiting element.

29. The direct current arc extinguishing circuit according to claim 19, wherein the apparatus is packaged as a device using insulating material.

30. The direct current arc extinguishing circuit according to claim 19, wherein the circuit is packaged as a device with a discharge unit configured to discharge the capacitor using insulating material.

* * * * *